US006625826B1

(12) United States Patent
Cheng

(10) Patent No.: US 6,625,826 B1
(45) Date of Patent: Sep. 30, 2003

(54) SAFETY DEVICE FOR FOLDABLE BABY BED

(76) Inventor: Pao-Hsien Cheng, No. 139, Jen Yi 1st Street, Jen Te Hsiang, Tainan Hsien (TW)

( * ) Notice: Subject to any disclaimer, the term of this patent is extended or adjusted under 35 U.S.C. 154(b) by 0 days.

(21) Appl. No.: 10/165,959

(22) Filed: Jun. 11, 2002

(51) Int. Cl.[7] ..... A47D 7/00
(52) U.S. Cl. ..... 5/99.1; 5/98.1
(58) Field of Search ..... 5/99.1, 98.1, 93.1, 5/98.3

(56) References Cited

U.S. PATENT DOCUMENTS 5,381,570 A * 1/1995 Cheng ..... 5/99.1
5,664,267 A * 9/1997 Cheng ..... 5/99.1
6,308,352 B1 * 10/2001 Cheng ..... 5/99.1

* cited by examiner

*Primary Examiner*—Teri Pham Luu
*Assistant Examiner*—Fredrick Conley
(74) *Attorney, Agent, or Firm*—Rosenberg, Klein & Lee

(57) ABSTRACT

A safety device for a foldable baby bed has a pivotal block fitted to one of pivotally connected base rods of the bed, and a locking member fitted to another of the base rods. A tube is pivoted to the pivotal block at a first end; the tube has a down facing cavity at a second end. The tube is movably passed through the locking member from the second end so that the cavity can fit onto a protrusion of the locking member when the bed is stretched to an in-use position where the base rods are positioned substantially on a plane; thus, the safety device prevents folding of the bed caused by unexpected force. The cavity is disengaged from the protrusion for allowing displacement of the base rods by means of lifting the second end of the tube.

6 Claims, 9 Drawing Sheets

SAFETY DEVICE FOR FOLDABLE BABY BED

BACKGROUND OF THE INVENTION

The present invention relates to a safety device for a foldable baby bed, and more particularly a safety device that can prevent the frame of a stretched baby bed from being folded by unexpected force when babies are still in the bed.

Referring to FIGS. 1 and 2, a conventional foldable baby bed has a frame that includes an upper part 1, four upright supports 2, a connecting rod combination 3, and a mattress support 4. The upper part has bending connectors 12, and corner connectors 11 so that it can be collapsed into smaller size. The upright supports 2 are connected to respective ones of the corner connectors 11 at upper ends, and are each connected to a corner foot 21 at a lower end. The connecting rod combination 3 includes two pairs of rods; the rods of each pair cross, and are pivoted to, each other; the rods are pivoted to respective ones of the corner feet 21 at outer ends; first feet 31 are provided to the combination to support the same on the ground when the bed is used. The mattress support 4 includes two connecting rods 41, which are pivoted to inner ends of the rods of the combination 3 at two ends; second feet 42 are provided to the rods 41 to support the same on the ground when the bed is used.

The folding operation of the frame of the foldable baby bed can be started by means of pulling a strap upwards that is connected to the mattress support 4. However, the bed is prone to be folded by unexpected force when babies are lying in it because it is not equipped with a safety device to prevent unintentional folding.

To overcome the above disadvantage, referring to FIGS. 3 and 4, the foldable baby bed is provided with a safety toggle combination, which includes two connecting members 51, a first arm 52, a second arm 53, a strap 56, and an intermediate arm 54. One of the connecting members 51 is joined to a first one of the two pairs of the rod combination 3, and the other one to the other one of the two pairs. The arms 52, and 53 are pivoted to respective connecting members 51 at outer ends, and pivoted to the intermediate arm 54 at inner ends. The strap 56 is connected to the intermediate arm 54. The safety toggle combination 5 can stretch to its full length with the intermediate arm 54 slightly sinking when the baby bed is unfolded for use, thus preventing unintentional folding of the bed due to unexpected force.

However, the safety toggle combination 5 is relatively complicated in structure, and therefore costs relatively much labor to assemble, causing increase of manufacturing cost.

SUMMARY OF THE INVENTION

Therefore, it is a main object of the present invention to provide such an uncomplicated safety device for a foldable baby bed that the manufacturing cost of the bed can be reduced.

It is another object of the present invention to provide such a safety device for a foldable baby bed that folding and stretching of the baby bed can be done with increased smoothness.

The safety device has a tube that is pivoted to a base rod of the bed frame at the first end, and is movably passed through a locking member at the second so that a down facing cavity of the second end of the tube can fit onto an up facing protrusion of the locking member when the bed is stretched to the in-use position. The tube will be made to stay engaged with the protrusion by the gravity when unexpected force acts on any part of the frame other than the tube therefore the safety device can prevent unintentional folding of the bed effectively.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
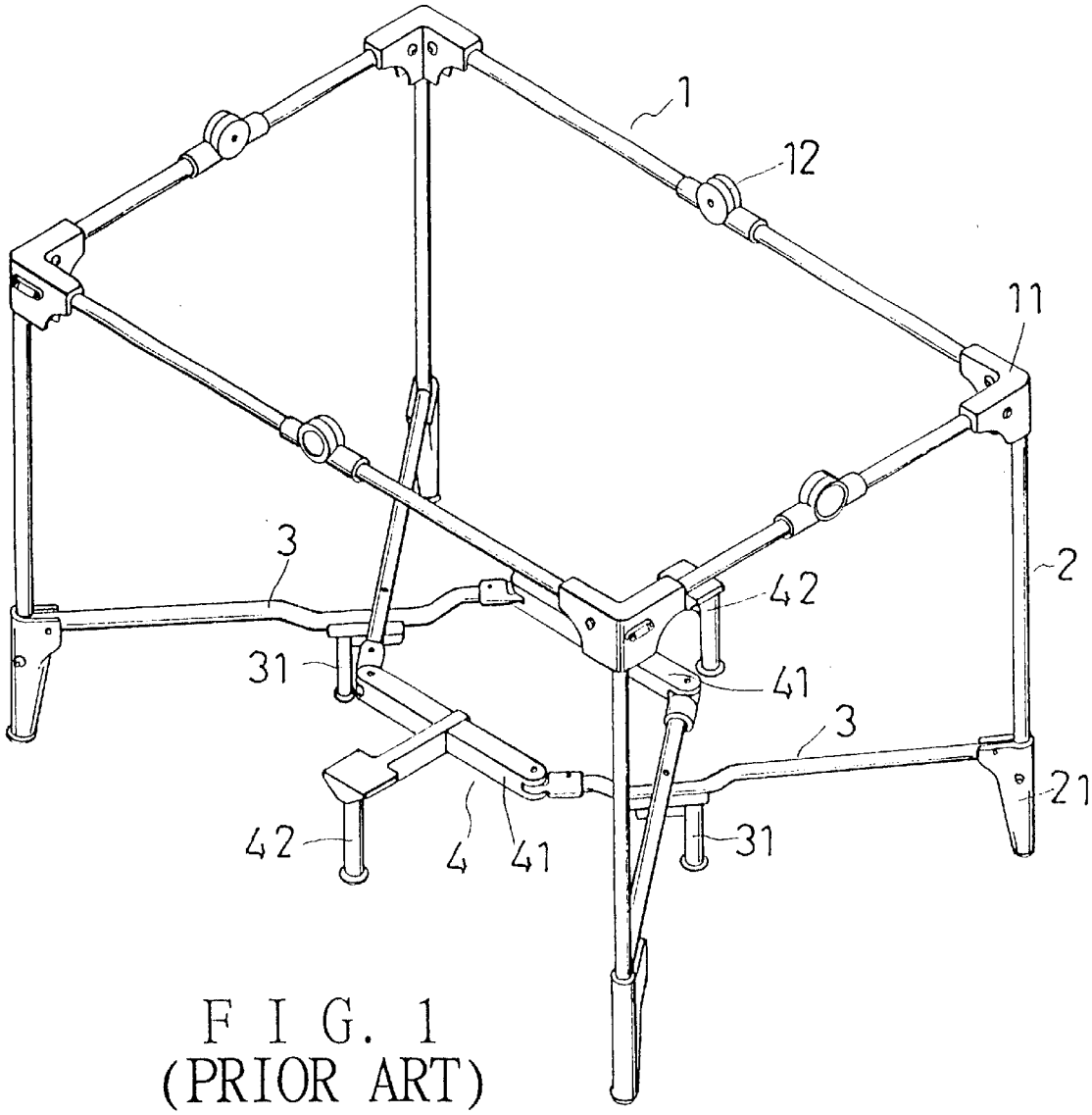
F I G. 1 (PRIOR ART)
FIG. 1 is a perspective view of the frame of the first conventional foldable baby bed.
Figure 2:
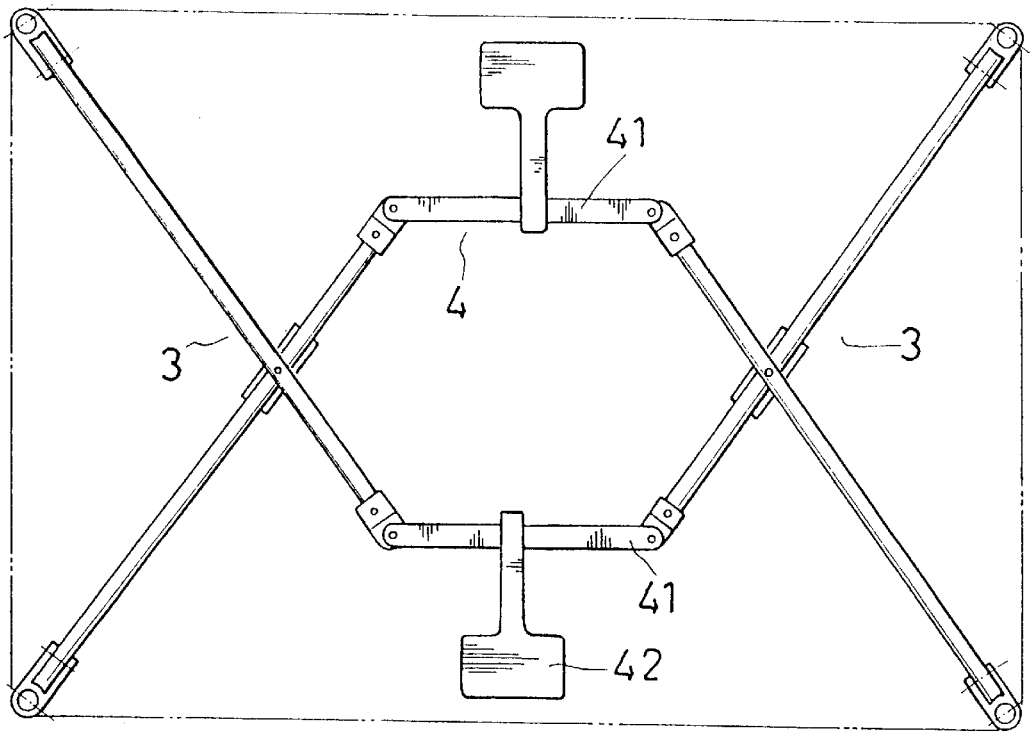
F I G. 2 (PRIOR ART)
FIG. 2 is a bottom view of the frame of the first conventional foldable baby bed.
Figure 4:
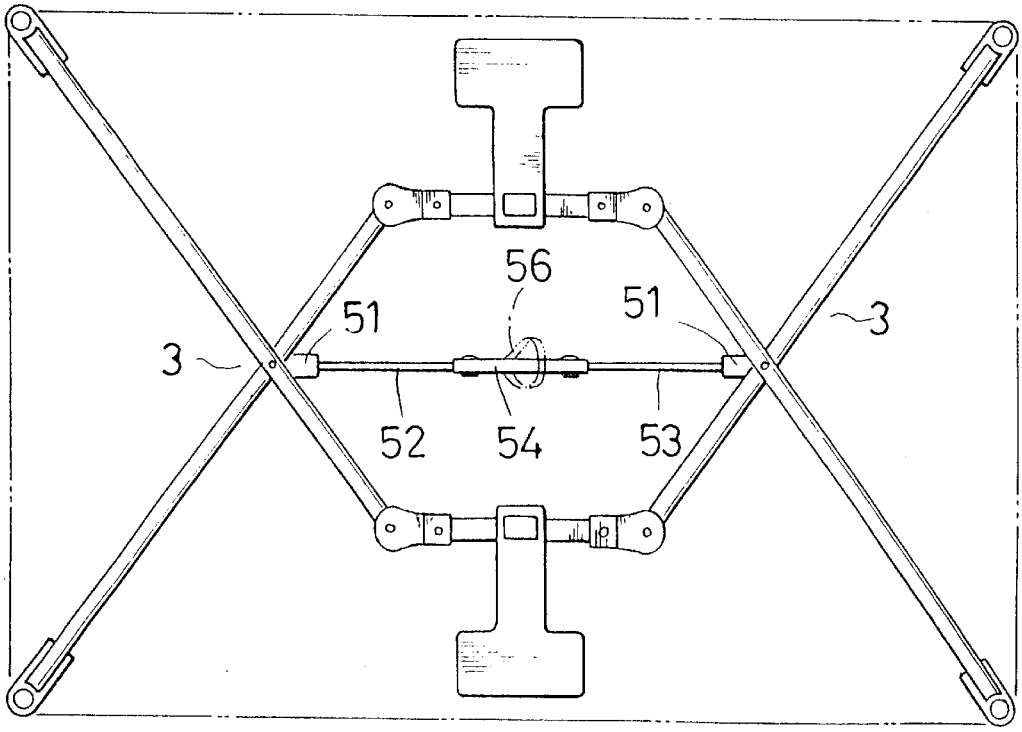
F I G. 4 (PRIOR ART)
FIG. 4 is a bottom view of the frame of the second conventional foldable baby bed.
Figure 3:
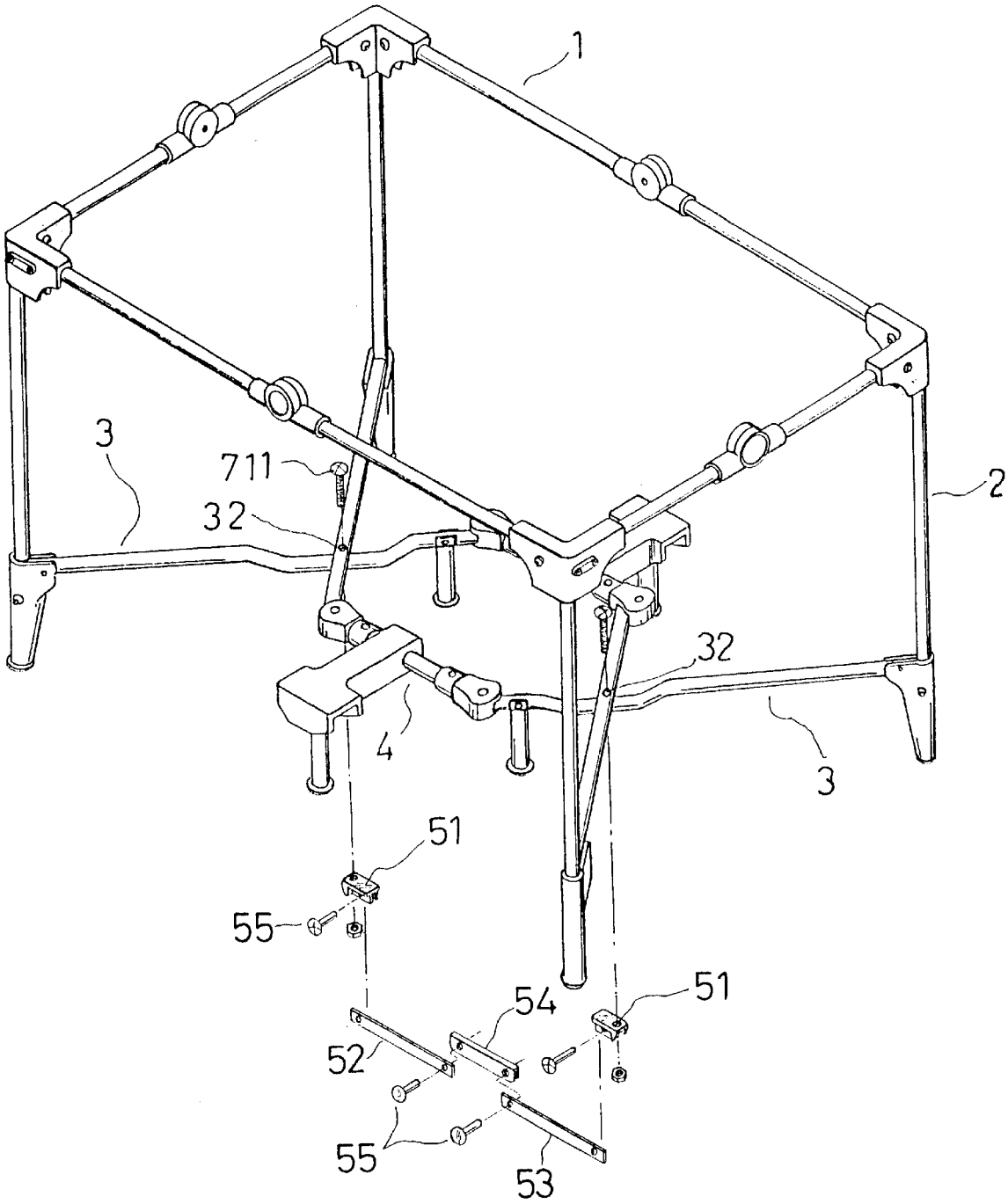
F I G. 3 (PRIOR ART)
FIG. 3 is a perspective view of the frame of the second conventional foldable baby bed.
Figure 5:
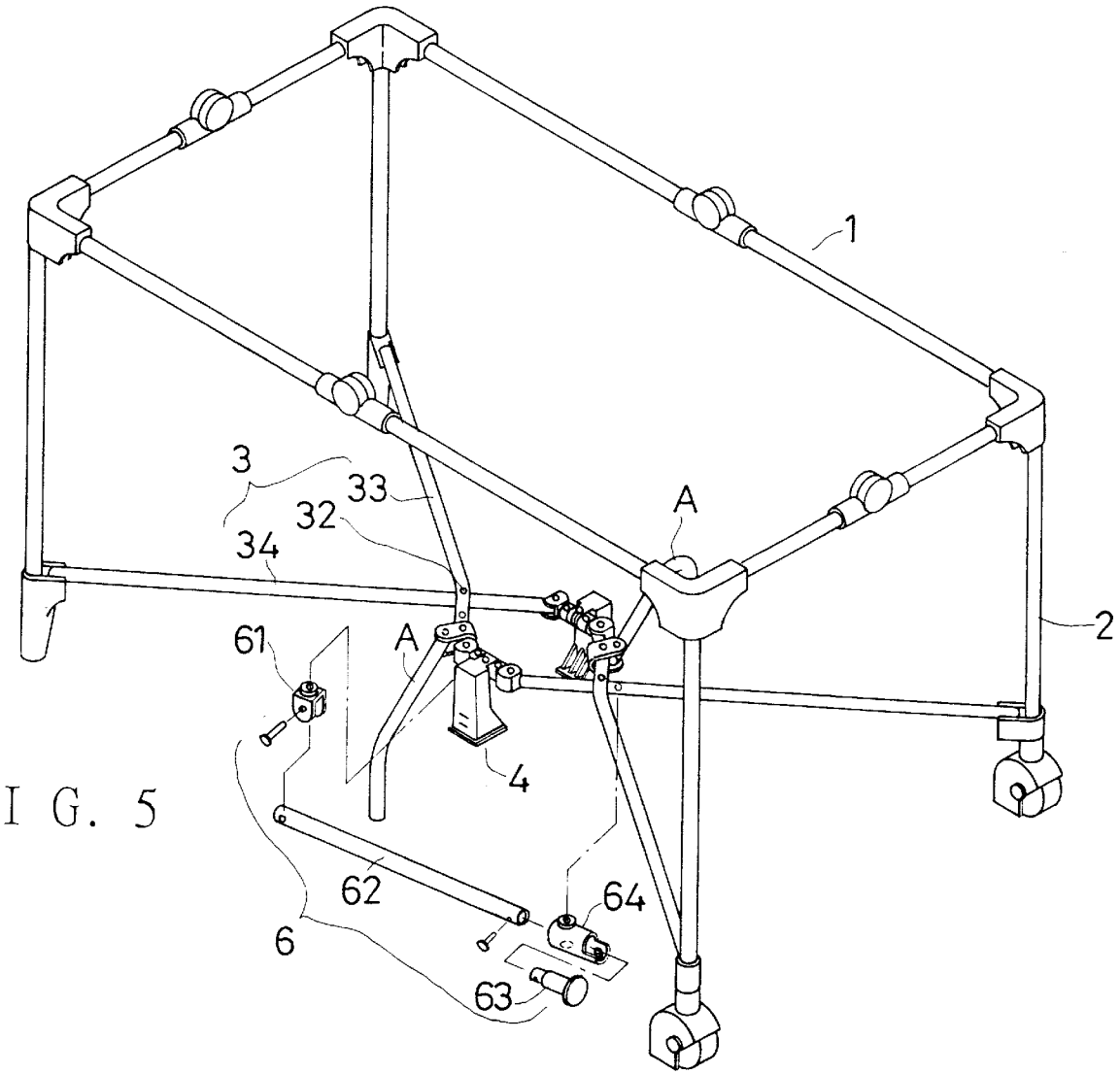
FIG. 5 is a perspective view of the frame of the foldable baby bed of the present invention.
Figure 6:
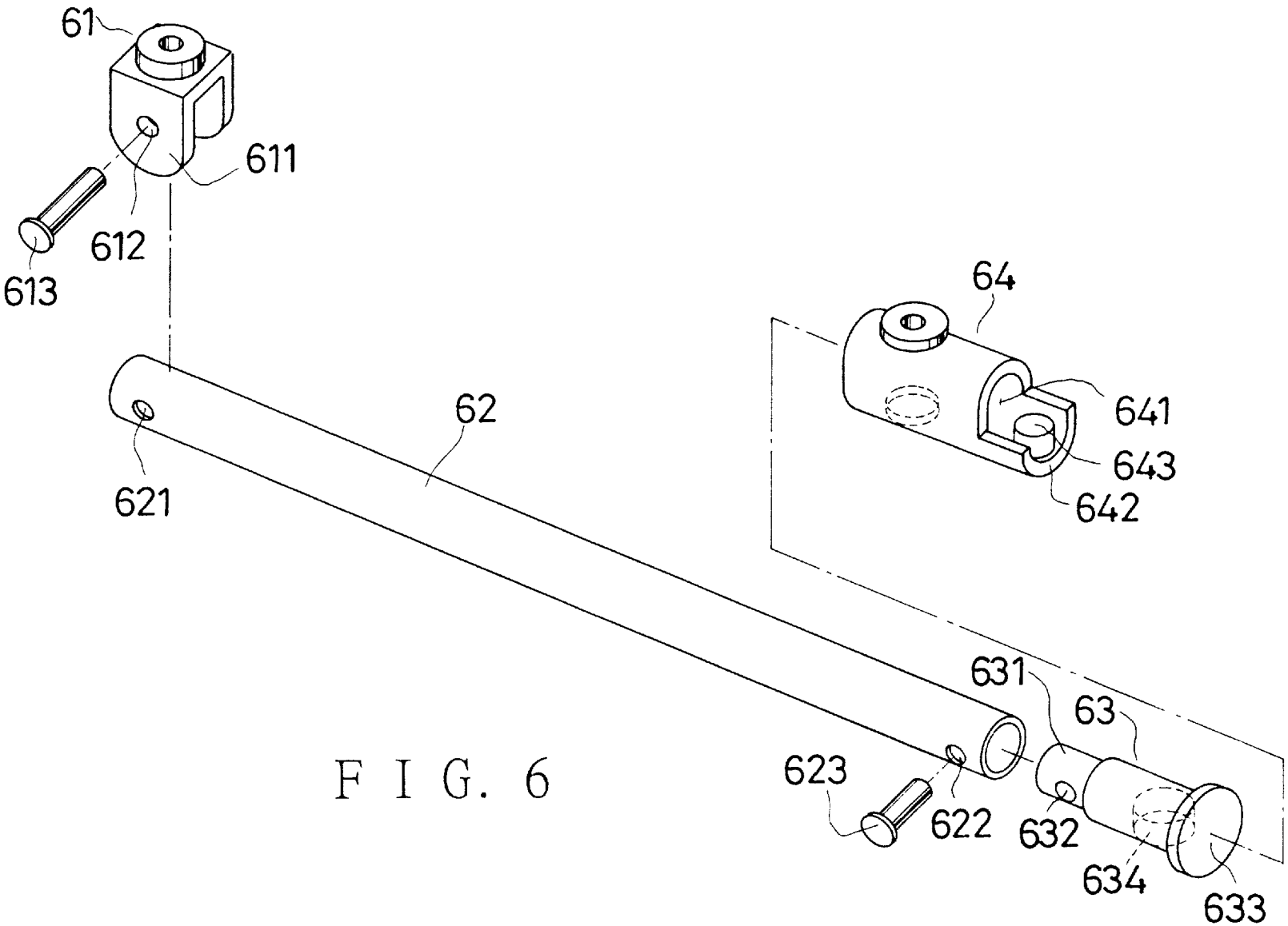
FIG. 6 is an exploded perspective view of the safety device of a foldable baby bed according to the present invention.

Referring to FIGS. 5 and 6, a safety device for a foldable baby bed according to the present invention includes a pivotal block 61, a tube 62, an engaging element 63, and a locking member 64.

The present safety device is to be fitted to a lower part of a foldable baby bed frame which can be made to include support feet 4, a first pair of lower connecting rods, and a second pair of base connecting rods 3. The first, and the second pairs each includes an upper, and a lower rods 33, and 34 that are positioned one on top of the other, and are pivoted to each other at intermediate pivotal joints 32. Two ends of the rods of the base connecting rods 3 are pivoted to other sections of the frame in a way same as that of the above conventional baby bed, therefore the connection thereof is not detailed again herein.

The pivotal block 61 is rotatably fitted to a bottom of the upper rod 33 of the first pair of base connecting rods 3; the pivotal block 61 is preferably positioned between the inner end of the corresponding upper rod 33 and the corresponding one of the pivotal joints 32. The pivotal block 61 has two opposing lateral walls 611 sticking down. The lateral walls 611 have opposing through holes 612.

The tube 62 has opposing through holes 621 at a first end. The first end of the tube 62 is received between, and pivoted to, the opposing lateral walls 611 of the pivotal block 61 with a pivotal pin 613 passing into the through holes 612, and 621.

The engaging element 63 has an insertion end portion 631 fixedly inserted into a second end of the tube 62. The second end of the tube 62 has opposing through holes 622, and the insertion portion 631 has a through hole 632. A fixing pin 623 is passed into the holes 622, and 632 to secure the engaging element 63 to the tube 62.

The locking member 64 is fitted to a bottom of the lower rod 34 of the second pair of base connecting rods 3; the locking member 64 is preferably positioned between the outer end of the corresponding lower rod 34 and the corresponding one of the pivotal joints 32. The locking member 64 has a hollow 641, an extension portion 642 that sticks out from a bottom thereof, and an engaging protrusion 643 that sticks up from the upper side of the extension portion 642.

The tube 62 is passed through the hollow 641 of the locking member 64 at the second end thereof so that the cavity 624 can fit onto the engaging protrusion 643 when the baby bed is stretched to an in-use position wherein the lower connecting rods 3 are positioned substantially on a same plane, thus preventing the lower connecting rods 3 from being displaced by unexpected external force. Because the cavity 634 will be made to stay engaged with the protrusion 643 by the gravity when unintentional force acts on any part of the frame other than the tube 62, the safety device can prevent unexpected folding of the bed effectively. The cavity 634 is disengaged from the engaging protrusion 643 for allowing displacement of the base connecting rods 3 by means of lifting the second end of the tube 62.

Figure 7:
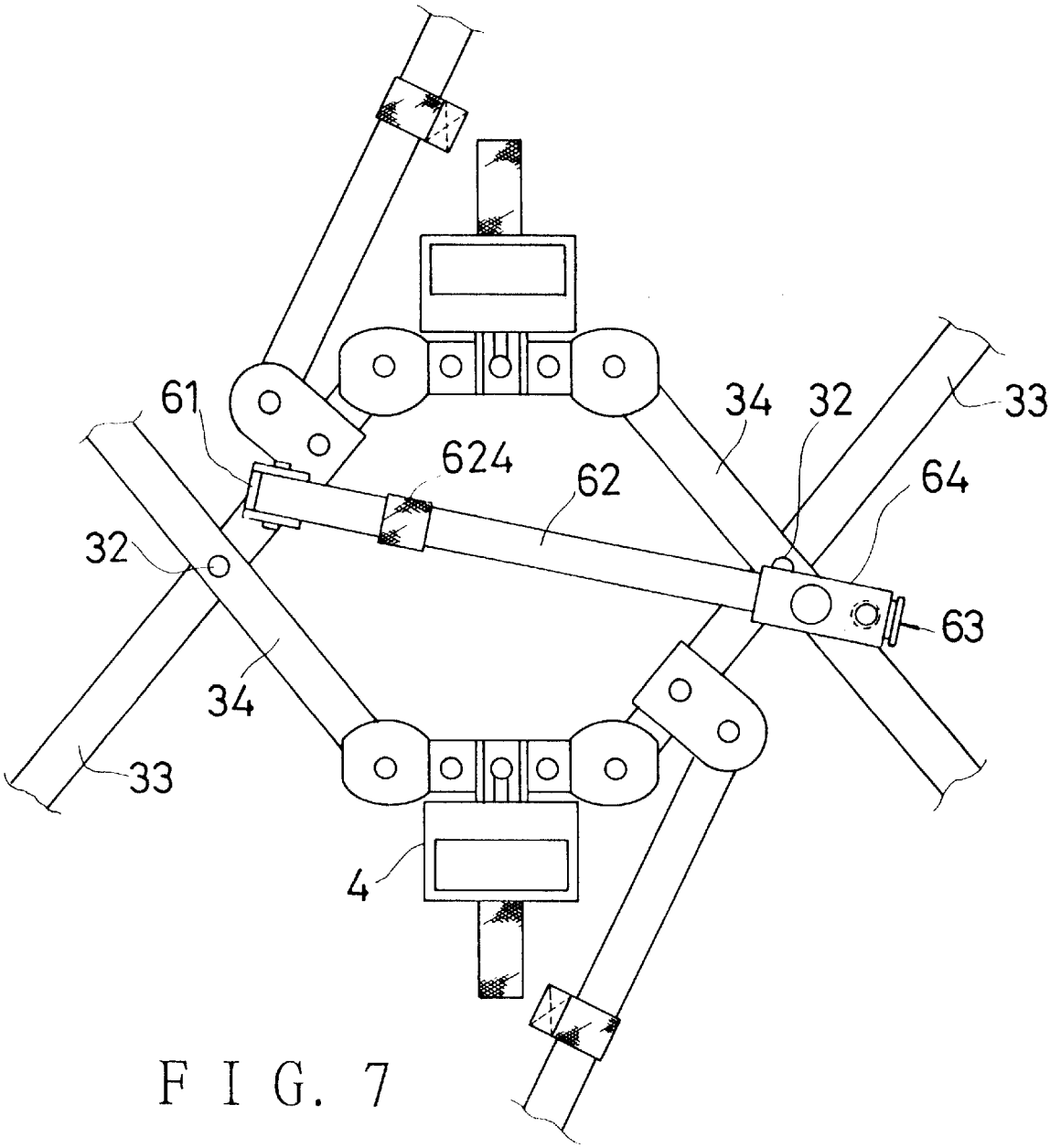
FIG. 7 is a fragmentary bottom view of the frame of a foldable baby bed with the safety device of the present invention.

In addition, the engaging element 63 is provided with a rim 633 at an outer end, which has a bigger diameter than the hollow 641 of the locking member 64; thus, the tube 62 can't possibly fall off the locking element 64. And, referring to FIG. 7, a handle 624 is provided to the tube 62 for the user to hold to operate the safety device and displace the base connecting rods 3.

Figure 8:
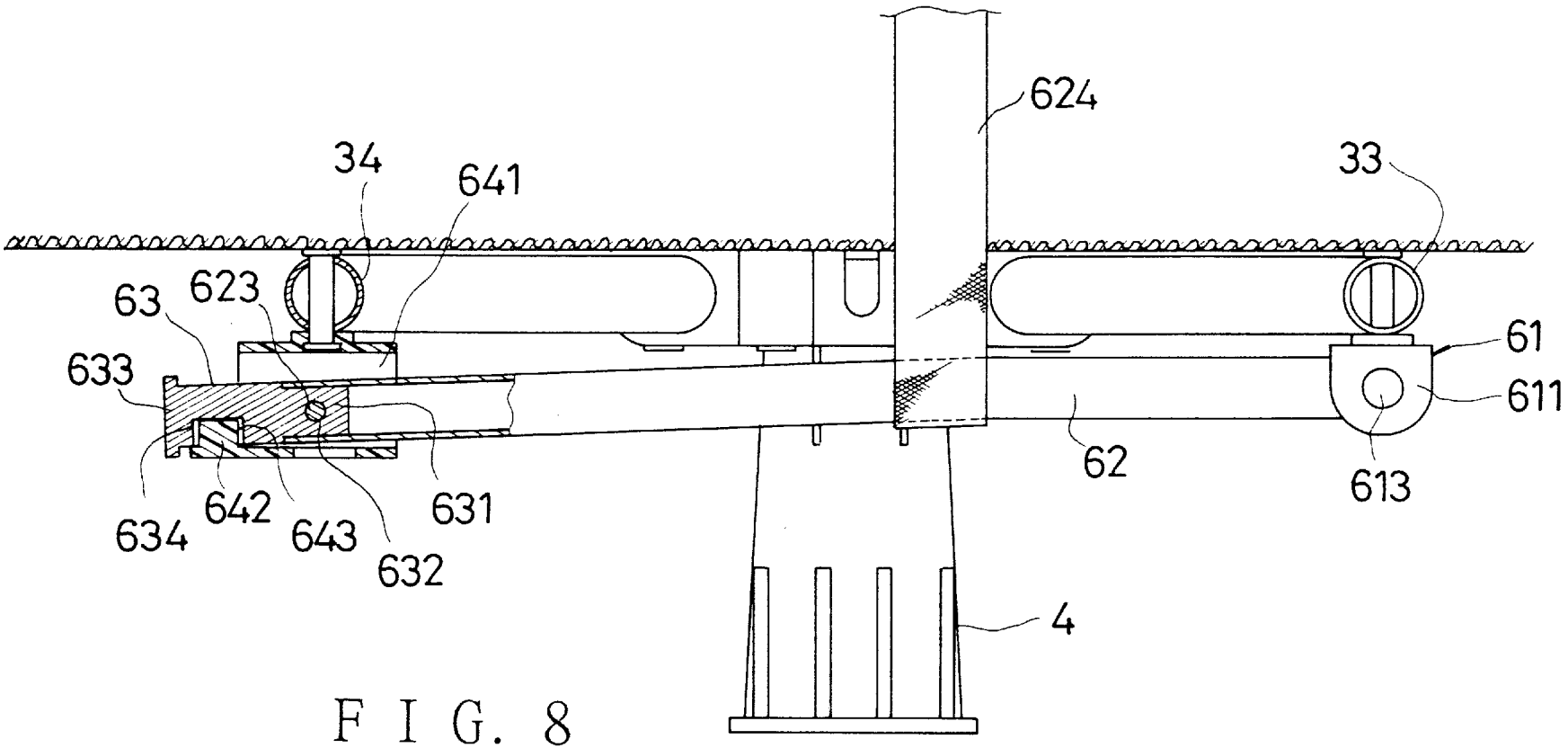
FIG. 8 is a side view of the safety device of a foldable baby bed according to the present invention.
Figure 9:
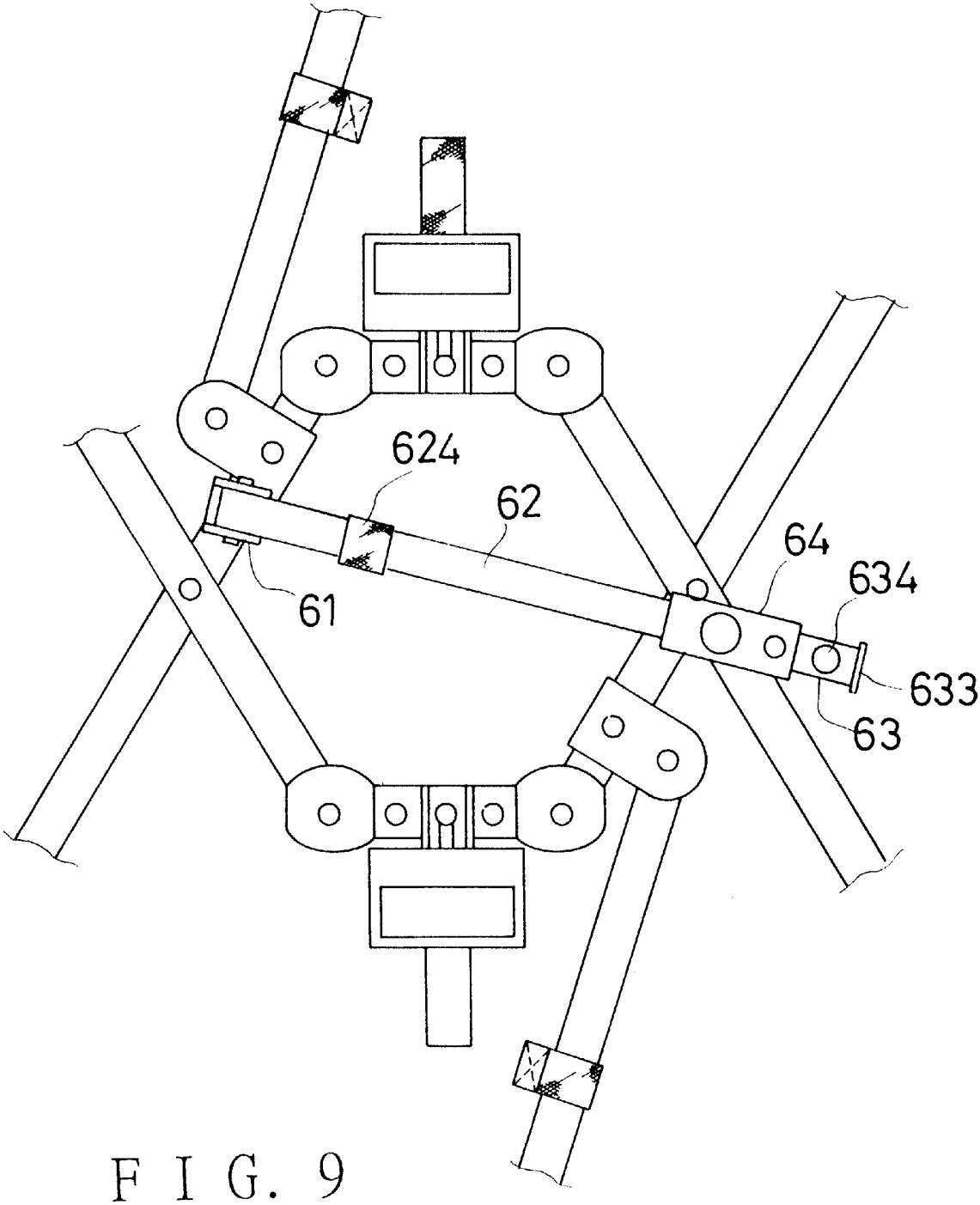
FIG. 9 is a fragmentary bottom view of the frame of a foldable baby bed with the present safety device being unlocked.
Figure 10:
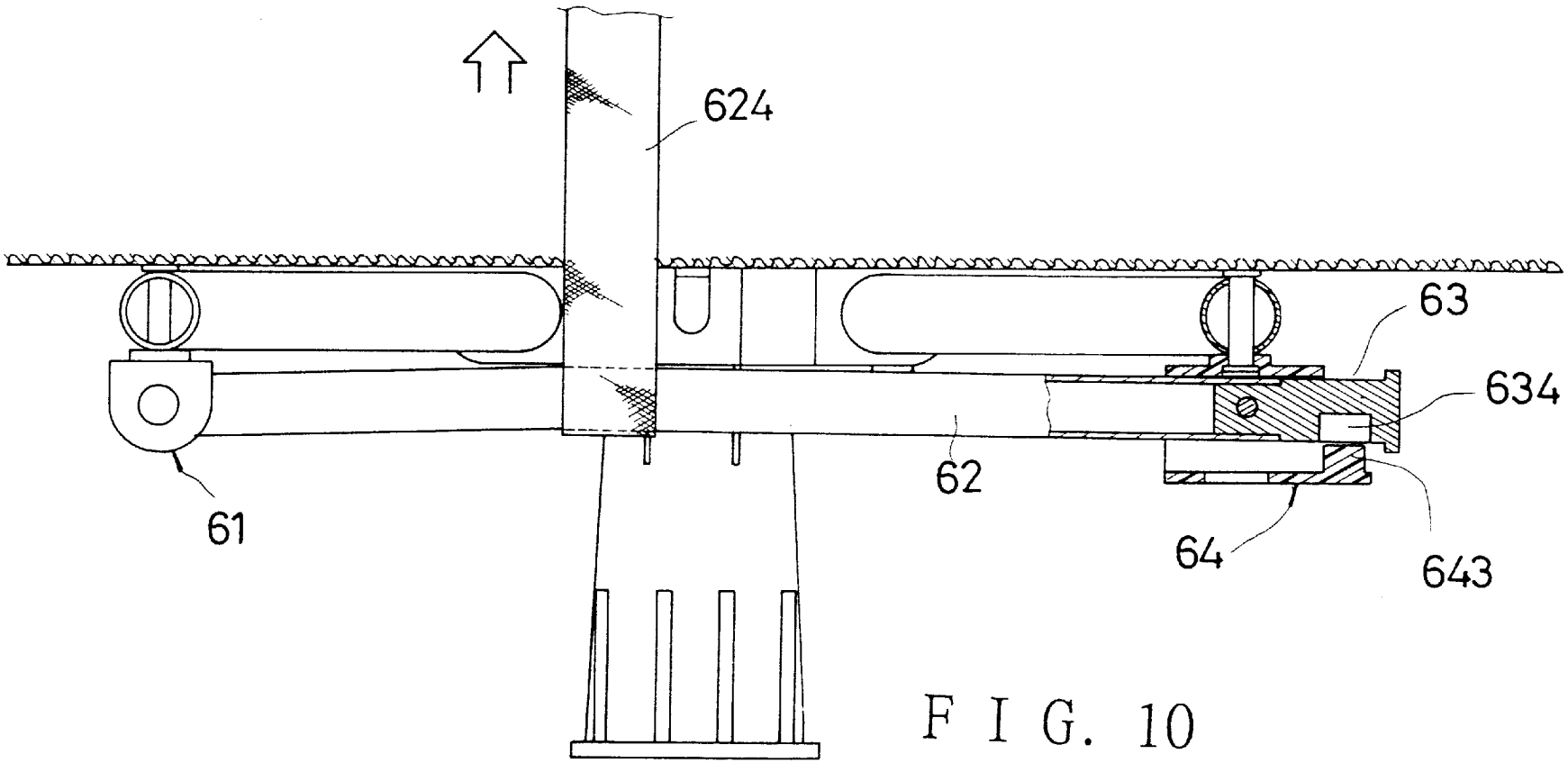
FIG. 10 is a side view of the safety device of the present invention in the unlocked position.

From the above description, it can be seen that the safety device for a foldable baby bed has advantages as followings:

1. The first end of the tube 62 is higher than the second end when the bed is in the stretched position, as shown in FIG. 8, because it is fitted to the upper one of the base connecting rods 3 while the second end is fitted under the lower one. Consequently, folding and stretching of the baby bed can be done with increased smoothness.
2. The cavity 634 can fit onto the engaging protrusion 643 automatically due to the gravity when the bed is stretched, therefore the safety device can be used with little effort.
3. The safety device is relatively uncomplicated in structure, and therefore costs relatively little labor to assemble, therefore the manufacturing cost can be reduced.

What is claimed is:

1. A safety device for a foldable baby bed, comprising a pivotal block rotatably fitted to a bottom of an upper one of a first pair of pivotally connected base connecting rods of the foldable baby bed;

a tube pivoted to the pivotal block at a first end thereof, the tube having a down facing cavity at a second end thereof;

a locking member fitted to a bottom of a lower one of a second pair of pivotally connected base connecting rods, which is allowed a displacement in relation to the first pair of base connecting rods by means of folding operation; the locking member having an up facing protrusion; the tube being movably passed through a hollow of the locking member at a second end thereof;

the cavity being capable of fitting onto the protrusion when the baby bed is stretched for use with the base connecting rods being positioned substantially on a same plane, thus preventing folding of the bed caused by external force that is not directed at the safety device; the cavity being disengaged from the protrusion for allowing displacement of the base connecting rods by means of lifting the second end of the tube.

2. The safety device for a foldable baby bed according to claim 1, wherein the pivotal block has two opposing lateral walls sticking down, and the tube is passed into between, and pivoted to, the opposing lateral walls.

3. The safety device for a foldable baby bed according to claim 1, wherein the up facing protrusion of the locking member is formed on an extension portion that sticks out from a bottom of the locking member.

4. The safety device for a foldable baby bed according to claim 1, wherein the down facing cavity is formed on a bottom of an engaging element fixedly inserted into the tube.

5. The safety device for a foldable baby bed according to claim 4, wherein the engaging element is provided with a rim at an outer end that has a bigger diameter than the hollow of the locking member for preventing the tube from falling off the locking element.

6. The safety device for a foldable baby bed according to claim 1, wherein the pivotal block, is arranged between an inner end of the corresponding rod and a pivotal joint of the first pair of base rods, and the locking member is arranged between an outer end of the corresponding rod and a pivotal joint of the second pair of base rods.

* * * * *